US006529869B1

(12) United States Patent
Wietzke et al.

(10) Patent No.: US 6,529,869 B1
(45) Date of Patent: Mar. 4, 2003

(54) PROCESS AND ELECTRIC APPLIANCE FOR OPTIMIZING ACOUSTIC SIGNAL RECEPTION

(75) Inventors: Joachim Wietzke, Hildesheim (DE); Rainer Cornelius, Diekholzen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/509,135

(22) PCT Filed: Mar. 17, 1998

(86) PCT No.: PCT/EP98/01537

§ 371 (c)(1),
(2), (4) Date: Jun. 1, 2000

(87) PCT Pub. No.: WO99/16285

PCT Pub. Date: Apr. 1, 1999

(51) Int. Cl.[7] ..... G10L 21/02
(52) U.S. Cl. ..... 704/240; 704/233
(58) Field of Search ..... 704/240, 233, 704/231, 200, 200.1, 270, 226, 227, 228

(56) References Cited

U.S. PATENT DOCUMENTS 4,802,227 A 1/1989 Elko et al.
5,737,431 A * 4/1998 Brandstein et al. ..... 381/92
5,828,997 A * 10/1998 Durlach et al. ..... 367/124
6,243,471 B1 * 6/2001 Brandstein et al. ..... 348/169
6,317,501 B1 * 11/2001 Matsuo ..... 381/122

FOREIGN PATENT DOCUMENTS

| | | |
|---|---|---|
| DE | 30 33 806 | 4/1981 |
| DE | 195 40 795 | 5/1997 |
| EP | 0 795 851 | 9/1997 |

* cited by examiner

*Primary Examiner*—Richemond Dorvil
(74) *Attorney, Agent, or Firm*—Kenyon & Kenyon

(57) ABSTRACT

A method of optimizing the reception of acoustic signals and an electric device, in particular, a telecommunications terminal, are described for interference-free reception of acoustic signals. At least two microphones can be connected to the electric device. The microphones convert acoustic signals received into electric signals. In addition, at least one adding element is provided to superimpose the electric signals of connected microphones with at least one phase delay element being provided to delay the phase of an electric signal before it is superimposed. The phase lag of the minimum of one phase delay element is selected so that the amplitude of the superimposed signal is in a predetermined range as a function of the location of the connected microphones for at least one predetermined location (55) when a sound source (55) delivers acoustic signals to the minimum of one predetermined location.

11 Claims, 2 Drawing Sheets

PROCESS AND ELECTRIC APPLIANCE FOR OPTIMIZING ACOUSTIC SIGNAL RECEPTION

FIELD OF THE INVENTION

The present invention relates to an electric device and a method of optimizing reception of acoustic signals.

BACKGROUND INFORMATION

Electric devices in the form of telephone terminals that permit voice data entry are already known. Voice data entry is accomplished here by using a hands-free microphone, for example.

SUMMARY OF THE INVENTION

A method and an electric device according to the present invention have an advantage in that a characteristic directional effect is achieved by phase-shifted superpositioning of electric microphone output signals. Sensitivity at a given location in space can be improved in this way, so that a sound source arranged there can be picked up especially well by microphones, and interference signal sources at other locations in space can be blanked out. This results in better comprehensibility not only for the human ear in transmission of voice signals over a telecommunications network, for example, but also for a voice processing system with a voice-controlled electric device, so that interference is not picked up from the outset and thus need not be suppressed by complicated measures. The word recognition probability of a voice recognition system is increased accordingly, and word analysis is simplified. There is less distortion of signals by background noise.

It is advantageous that it is possible to set different phase lags on the minimum of one phase delay element. This allows maximum reception to be set for the superimposed signal regardless of location.

It is advantageous that a signal processing unit is provided to receive the electric signals of the microphones and to determine coordinates of at least one sound source as a function of the amplitudes of the electric signals.

In this way, two-dimensional and three-dimensional images of the sound environment can be calculated from the signals picked up, depending on the number and site selection of the microphones, so that the location of all sound sources can be determined. Then the phase lag of the minimum of one phase delay element can be set on the basis of this information in such a way that maximum reception for the superimposed signal is obtained for a desired sound source.

Another advantage is that a voice analysis device is provided for the signal processing unit, and the voice analysis device performs a comparison of parameters of the electric signals with voice parameters stored in a memory unit, and it identifies a sound source as a voice source with a probability value determined as a function of the result of the comparison. The phase lag of the minimum of one phase delay element can be set in this way so as to obtain maximum reception for the superimposed signal at the location of the voice source. Thus, voice signals from this voice source are received with a high sensitivity, whereas interference signals from other sound sources are blanked out.

One particular advantage is that the signal processing unit sets the phase lag of the minimum of one phase delay element as a function of the location of the identified voice source in such a way that maximum reception for the superimposed signal is obtained at the location of the voice source. The phase lag of the minimum of one phase delay element is thus set automatically in this way without the intervention of a user, and the location of the greatest sensitivity can also be corrected adaptively to the site of the voice source. This constitutes a great improvement in operating convenience for the user.

DETAILED DESCRIPTION

Figure 1:
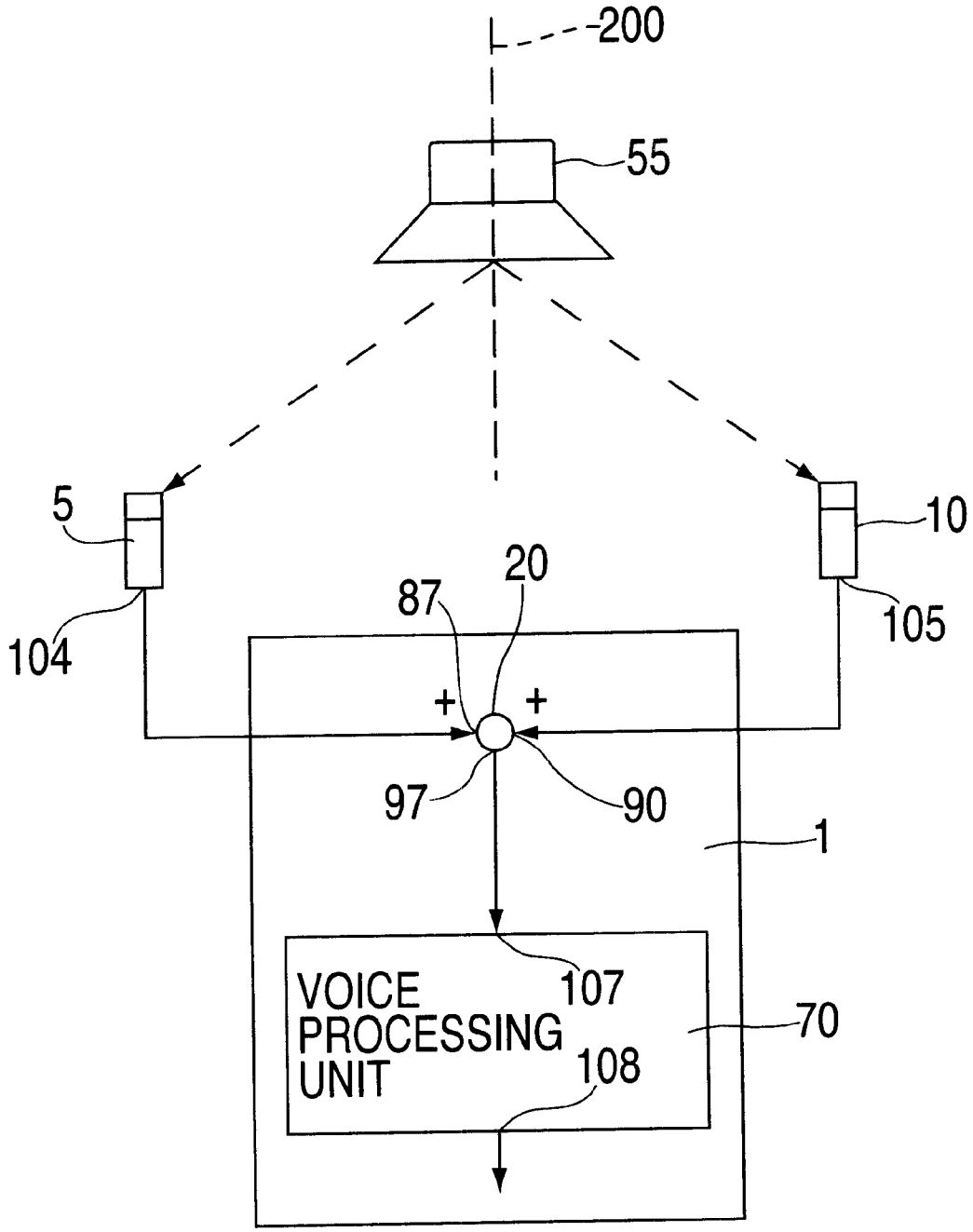
FIG. 1 shows a block diagram of an electric device, the electric device being coupled to microphones whose output signals are superimposed without a phase shift.

FIG. 1 shows an electric device 1 which is capable of voice data entry and is designed as a telecommunications terminal. Telecommunications terminal 1 includes an adding element 20 and a voice processing unit 70. One output 97 of adding element 20 is connected to an input 107 of voice processing unit 70. One output 108 of voice processing unit 70 is connected to a telecommunications network (not shown in FIG. 1). A first microphone 5 and a second microphone 10 are connected to telecommunications terminal 1. One output 104 of first microphone 5 is connected to a first non-inverting input 87 of adding element 20, and one output 105 of second microphone 10 is connected to a second non-inverting input 90 of adding element 20. According to FIG. 1, a sound source 55, designed as a loudspeaker delivering voice signals, is arranged an equal distance from both microphones 5, 10. Voice signals are received by both microphones 5, 10 according to the arrows shown with dotted lines in FIG. 1. Sound source 55 designed as a voice source may be, for example, the voice of a user of telecommunications terminal 1. Microphones 5, 10 convert the received voice signals into electric signals and relay them to adding element 20, where they are superimposed by simple addition. Since voice source 55 is located an equal distance away from both microphones 5 and 10, the voice signal emitted by it is analyzed twice in adding element 20 due to the superpositioning of the electric output signals of microphones 5, 10. Thus, voice source 55 is at a location for which the superimposed signal at output 97 of adding element 20 yields a maximum sensitivity, i.e., maximum reception. The locations of the maximum reception are repeated at the distance of the wavelength of the signal. Since speech is a randomly distributed mixture of frequencies, on the average there is maximum reception only at the geometric center between two microphones 5, 10 according to a dotted line 200 in FIG. 1.

Figure 2:
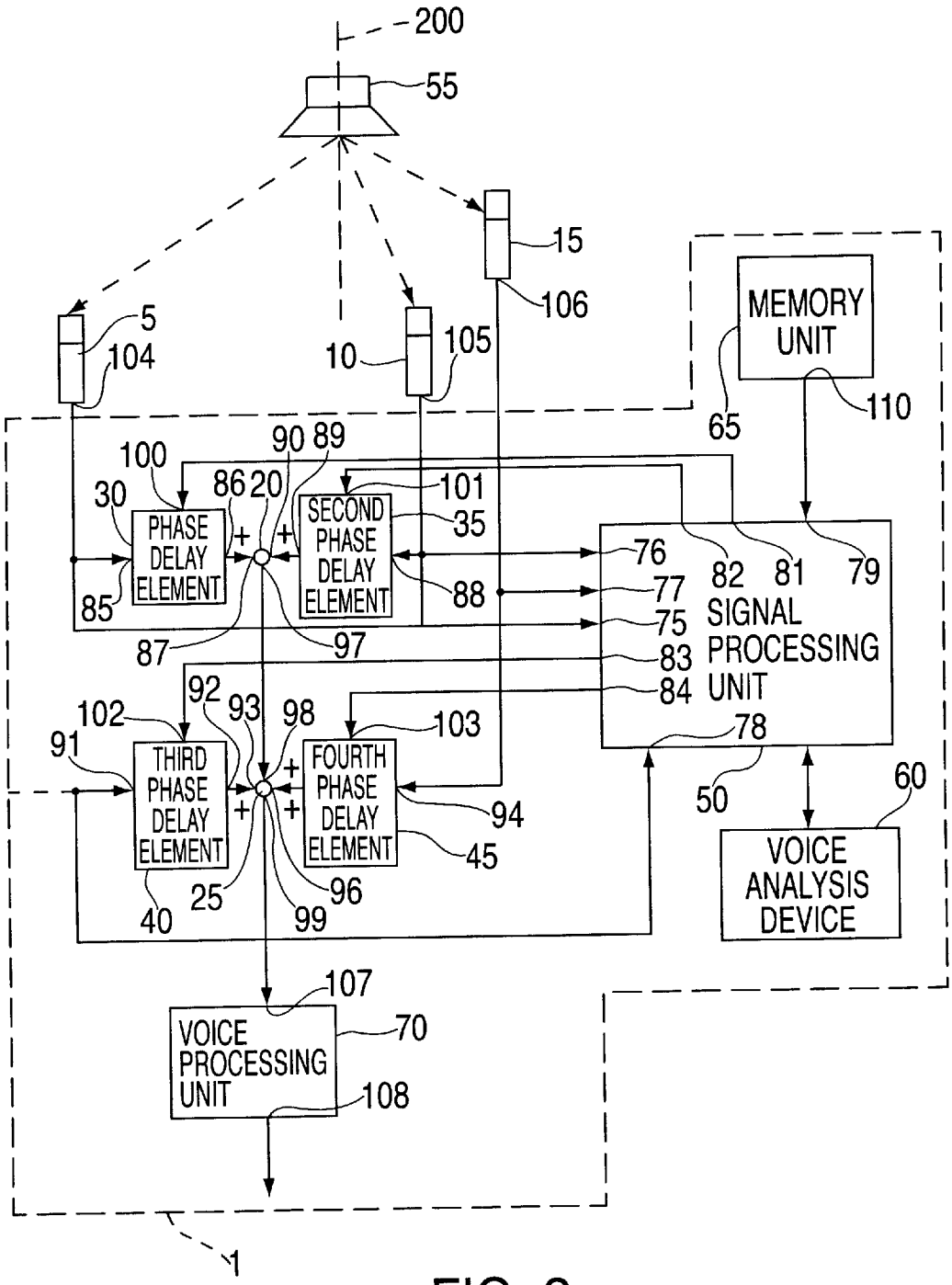
FIG. 2 shows a block diagram of an electric device according to the present invention, the electric device being coupled to microphones whose output signals can be superimposed with a phase shift.

FIG. 2 shows an electric device 1 which is capable of voice data entry and is designed as a telecommunications terminal according to the present invention. It includes a first phase delay element 30, a second phase delay element 35, a third phase delay element 40 and a fourth phase delay element 45. Telecommunications terminal 1 also has a signal processing unit 50, a voice analysis device 60 and a memory unit 65. Furthermore, telecommunications terminal 1 also has a first adding element 20 and a second adding element 25 plus a voice processing unit 70. A first microphone 5, a second microphone 10 and a third microphone 15 are connected to telecommunications terminal 1. One output 104 of first microphone 5 is connected to a first input 85 of first phase delay element 30 and to a first input 75 of signal processing unit 50. One output 86 of first phase delay element 30 is connected to a first non-inverting input 87 of first adding element 20. One output 105 of second microphone 10 is connected to a first input 88 of second phase delay element 35 and to a second input 76 of signal processing unit 50. One output 89 of second phase delay element 35 is connected to a second non-inverting input 90 of first adding element 20. One output 106 of third microphone 15 is connected to a first input 94 of fourth phase delay element 45 and to a third input 77 of signal processing unit 50. One output 95 of fourth phase delay element 45 is connected to a first non-inverting input 96 of second adding element 25. Another microphone (not shown in FIG. 2) may be connected at its output to a connecting line (shown with a dotted line in FIG. 2) leading to a first input 91 of third phase delay element 40 and to a fourth input 78 of signal processing unit 50. An output 92 of fourth phase delay element 40 is connected to a second non-inverting input 93 of second adding element 25. One output 97 of first adding element 20 is connected to a third non-inverting input 98 of second adding element 25. One output 99 of second adding element 25 is connected to one input 107 of voice processing unit 70. One output 108 of voice processing unit 70 is connected to a telecommunications network (not shown in FIG. 2). Voice processing unit 70 according to FIGS. 1 and 2 has at least the function of processing the superimposed electric voice signals for transmission in the telecommunications network and delivering them to the network. Other microphones may optionally also be connected to telecommunications terminal 1 and their signals superimposed with the other electric voice signals by way of corresponding phase delay elements and adding elements and sent to voice processing unit 70. In addition, the output signals of these additional microphones are also sent to signal processing unit 50. In the embodiment illustrated in FIG. 2, which is intended for connecting a maximum of four microphones, signal processing unit 50 has a fifth input 79 connected to an output 110 of memory unit 65. Furthermore, a voice analysis device 60 is connected to signal processing unit 50 for mutual data exchange. In addition, a first output 81 of signal processing unit 50 is connected to a second input 100 of first phase delay element 30. A second output 82 of signal processing unit 50 is connected to a second input 101 of second phase delay element 35. A third output 83 of signal processing unit 50 is connected to a second input 102 of third phase delay element 40. A fourth output 84 of signal processing unit 50 is connected to a second input 103 of fourth phase delay element 45. In addition, FIG. 2 also shows a sound source 55 in the form of a loudspeaker delivering voice signals; the sound source may be the voice of a user, for example. Three microphones 5, 10, 15 receive voice signals from sound source 55 in the form of a voice source according to the arrows shown with dotted lines in FIG. 2. According to FIG. 2, voice source 55 is located at a geometric location (represented by a dotted line 200) which no longer forms the geometric center of three microphones 5, 10, 15, in contrast with the arrangement according to FIG. 1, so these three microphones 5, 10, 15 are arranged at different distances from voice source 55.

If an eccentric directional effect is to be achieved, the location at which the superimposed signal of the electric voice signals yields maximum reception may be predetermined by a suitable selection of the phase lag of individual phase delay elements 30, 35, 40, 45. In this way, maximum reception can also be achieved for the eccentric arrangement of voice source 55 according to FIG. 2. Depending on the location of voice source 55, it may be sufficient to induce a phase lag in only a single microphone output signal, so then only one phase delay element would be necessary when limited to this application. By using one phase delay element for each microphone, however, there is a greater flexibility in preselecting the location of voice source 55 at which the superimposed signal at input 107 of voice processing unit 70 yields maximum reception. Since the mounting sites of microphones 5, 10 and 15 are also important factors in achieving maximum reception, maximum reception for the superimposed signal may also be achieved through a suitable arrangement of microphones 5, 10 and 15 as well as through a suitable selection of the phase lags of phase delay elements 30, 35, 40, 45 at a given location for voice source 55. However, if the mounting sites of microphones 5, 10, 15 cannot be varied, then maximum reception for the superimposed signal can be achieved only by varying the phase lags of phase delay elements 30, 35, 40, 45.

The reception sensitivity of telecommunications terminal 1 for certain areas can be increased or decreased through a suitable choice of mounting sites for microphones 5, 10, 15 and the phase lags of phase delay elements 30, 35, 45 connected to microphones 5, 10, 15, so that interfering sound sources can substantially be blanked out in areas of low sensitivity, and useful sound sources can be received better in the area of increased sensitivity. The reception sensitivity in a predetermined area can be specified for each sound source.

Signal processing unit 50 may optionally also calculate a three-dimensional image of the sound environment on the basis of the output signals of microphones 5, 10, 15 supplied to the signal processing unit, so the location of all sound sources can be determined. When only two microphones are used, only a two-dimensional image of the sound environment can be created. When more than three microphones are used, the accuracy in locating the sound sources can be increased, but this also increases the necessary computation expense. Parameters of the electric microphone output signals can be compared with voice parameters stored in memory unit 65 by using voice analysis device 60. Depending on the result of this comparison, signal processing unit 50 determines for each sound source detected in the sound environment a value for the probability of recognizing the respective sound source as a voice source. The sound source having the highest probability value is then identified as the voice source. With this information, the phase lags of phase delay elements 30, 35, 45 connected to microphones 5, 10, 15 can be set so that maximum reception for the superimposed signal is obtained at the location of the sound source identified as the voice source. The other sound sources are thus substantially blanked out as interference sources. The corresponding setting of the phase lags may also be performed automatically by signal processing unit 50, so the phase shifts of phase delay elements 30, 35, 45 connected to microphones 5, 10, 15 can be adapted to a changing location of the sound source identified as the voice source, so that maximum reception for the superimposed signal is maintained at the location of voice source 55 despite a relative motion between voice source 55 and telecommunications terminal 1, i.e., microphones 5, 10, 15.

When several sound sources are recognized with high probability values, one sound source may also be specified as a voice source by the user. For example, this is advantageous when telecommunications terminal 1 is integrated into a car radio, and both the driver and the passenger may be considered as a voice source. Then through appropriate changes in the phase lags of phase delay elements 30, 35, 45 connected to microphones 5, 10, 15, the driver or a passenger may be selected as voice source 55, so that maximum reception for the superimposed signal is achieved for the location of the selected voice source.

If microphones 5, 10, 15 are part of a hands-free device of telecommunications terminal 1, then voice signals of a voice source 55 may be picked up in a targeted manner in terms of location and thus with practically no interference. The voice comprehensibility of voice signals picked up by the hands-free device is thus greatly improved.

The present invention is not limited to a telecommunications device 1 but instead can be used for all electric devices capable of voice data entry. For example, this may also include devices having voice control. In this case, voice processing unit 70 is used to analyze and prompt voice commands. Interference-free reception is advantageous in analyzing voice commands, for example so that separation of useful signals and interference signals according to the present invention permits the best possible detection of voice commands without requiring any special mechanical aids such as directional microphones or special filter algorithms to eliminate the interference signals.

In the embodiment of electric device 1 capable of voice data entry as a telecommunications terminal, telecommunications terminal 1 need not be arranged in a stationary position because of the adaptive correction of maximum reception for the superimposed signal with any relative motion between telecommunications terminal 1 and voice source 55. Therefore, the present invention can also be applied to radios, cellular telephones, cordless telephones and the like. The same thing is also true of mobile electric devices capable of voice data entry with voice control. Electric devices capable of voice data entry with voice control may include, for example, car radios, personal computers and the like, but may also include both wire-bound and wireless telecommunications terminals.

Instead of implementing the phase lags and additions with discrete modules, it is also possible to implement them in signal processing unit 50 or a separate signal processing unit. For example, a digital signal processor may be used as the signal processing unit.

The method and the electric device according to the present invention can be used in general to optimize reception of any acoustic signals, so it is not necessary to restrict it to electric devices capable of voice data entry. Voice analysis is not necessary then. Suitable criteria would then be chosen for selecting a sound source as the useful sound source accordingly, and these criteria would be taken into account by signal processing unit 50 accordingly. It is also possible to provide for a user to select a sound source as the useful sound source at an input unit. Sound sources not selected as the useful sound source are then blanked out by using suitable phase lags. The phase lags are set by signal processing unit 50 so that adaptive correction of the reception sensitivity is performed as a function of the location of the useful sound source, and interference sound sources are blanked out adaptively, depending on their location.

What is claimed is:

1. A method of optimizing a reception of an acoustic signal, comprising the steps of:

converting the acoustic signal received by at least two microphones into electric output signals;

imposing a phase lag on at least one of the electric output signals;

superimposing signals derived from the electric output signals;

deriving voice parameters from the electric output signals;

comparing the voice parameters with predetermined voice parameters;

identifying at least one sound source as a voice source with a corresponding probability value, the corresponding probability value being determined as a function of the comparison of the voice parameters with the predetermined voice parameters;

selecting the identified at least one sound source as the voice source; and delaying a phase of at least one of the electric signals before superimposing the signals derived from the electric output signals, the phase delay being a function of a location of the at least two microphones such that a maximum reception for the superimposed signals derived from the electric output signals is obtained at a location of the selected voice source.

2. The method according to claim 1, wherein the step of selecting the voice source includes the step of selecting the voice source as the at least one sound source with a highest corresponding probability value.

3. The method according to claim 1, wherein the step of selecting the voice source includes the step of selecting the voice source via user input.

4. The method according to claim 1, further comprising the step of:

determining a set of position coordinates for the at least one sound source as a function of amplitudes of the electric output signals.

5. An electric device that is coupled to a plurality of microphones, the plurality of microphones converting received acoustic signals into a plurality of electric output signals, the electric device comprising:

an arrangement for superimposing signals derived from the electric output signals;

at least one phase delay element for delaying a phase of one of the electric output signals before the signals derived from the electric output signals are superimposed;

a memory unit for storing voice parameters;

a voice analysis device for comparing parameters of the electric output signals with the stored voice parameters, wherein at least one sound source is identified and selected as a voice source in accordance with a corresponding probability value that is determined as a function of a result of the comparing of the parameters of the electric output signals with the stored voice parameters; and a signal processing unit for setting a phase lag of the at least one phase delay element as a function of a location of the plurality of microphones such that a maximum reception for the superimposed signals is obtained at a location of the selected voice source.

6. The electric device according to claim 5, wherein the electric device corresponds to a telecommunications terminal.

7. The electric device according to claim 5, wherein the arrangement for superimposing includes an adding element.

8. The electric device according to claim 5, wherein different phase lags of the at least one phase delay element can be set.

9. The electric device according to claim 5, wherein the signal processing unit receives the electric output signals and determines position coordinates of the at least one sound source as a function of amplitudes of the electric output signals.

10. The electric device according to claim 5, wherein the signal processing unit selects a sound source with a highest corresponding probability value as the voice source.

11. The electric device according to claim 5, wherein the selection of the voice source is performed as a function of a user selection.

* * * * *

UNITED STATES PATENT AND TRADEMARK OFFICE

CERTIFICATE OF CORRECTION

PATENT NO. : 6,529,869 B1
DATED : March 4, 2003
INVENTOR(S) : Joachim Wietzke et al.

It is certified that error appears in the above-identified patent and that said Letters Patent is hereby corrected as shown below:

Title page,
Item [57], ABSTRACT,
Lines 14 and 15, delete "(55)" both occurrences.

Column 4,
Line 11, delete "also important".
Line 26, change "substantially be" to -- be substantially --.

Signed and Sealed this

Seventeenth Day of February, 2004

JON W. DUDAS
*Acting Director of the United States Patent and Trademark Office*